United States Patent [19]

Hatch

[11] 4,194,803

[45] Mar. 25, 1980

[54] CONNECTOR FOR FLAT RIBBON CABLE

[75] Inventor: David A. Hatch, Sherborn, Mass.

[73] Assignee: PINTEK, Inc., Newton Upper Falls, Mass.

[21] Appl. No.: 906,055

[22] Filed: May 15, 1978

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,820,055 | 6/1974 | Huffnagle et al. | 339/97 P |
| 3,858,159 | 12/1974 | Worth | 339/99 R |
| 3,899,236 | 8/1975 | Santos | 339/98 |
| 4,062,616 | 12/1977 | Shaffer et al. | 339/99 R |
| 4,068,912 | 1/1978 | Hudson, Jr. et al. | 339/99 R |

FOREIGN PATENT DOCUMENTS

| | | | |
|---|---|---|---|
| 2604027 | 9/1976 | Fed. Rep. of Germany | 339/99 R |

*Primary Examiner*—Joseph H. McGlynn
*Attorney, Agent, or Firm*—John E. Toupal

[57] ABSTRACT

A connector for terminating flat ribbon cable composed of flexible electrical insulation and retaining a plurality of electrically isolated, parallel conductors. The connector includes a housing that defines a slot for receiving an end of a flat ribbon cable to be terminated and comprises a base that defines a row of contact receptacles extending transversely to the slot and aligned with individual conductors in the cable. Also comprising the housing is a cover adapted for mating engagement with the base and defining catch wall portions extending transversely to the cable slot. Retained by each of the receptacles is a contact having a head portion having cutting edges shaped and arranged to receive and penetrate the insulation surrounding a different conductor in the cable and to make electrical contact therewith. The contacts also include latch portions for engaging and fastening the cover of the housing to the base. Included in each latching portion is a tab extending substantially longitudinally of the slot and parallel to the cable conductors and arranged to engage the catch wall portion of the cover.

21 Claims, 5 Drawing Figures

CONNECTOR FOR FLAT RIBBON CABLE

BACKGROUND OF THE INVENTION

This invention relates generally to a connector for terminating flat ribbon cable, and more particularly, to such a connector having contacts that latch together portions of a housing in addition to serving as signal outlets for the multiple conductors of the cable.

Flat ribbon cable has come into extensive use in electronic applications requiring the transmission of noise and cross-talk free signals. The cables retain a series of spaced apart, parallel conductors imbedded within a flexible sheet of electrically insulative material. Mass termination of the plural conductors is normally made in a connector having a series of aligned electrical contacts spaced apart so as to coincide with the individual cable conductors. Although costly labor intensive solder and welding techniques are sometimes utilized for connecting the contacts and individual conductors, more recent conductor connector devices employ contacts shaped and arranged to penetrate the insulation surrounding the individual conductors and to move into electrical engagement therewith.

A problem exhibited by many connectors of the insulation piercing type results from inadvertent misalignment between individual contacts and conductors. Such misalignment can cause undesirable electrical connection between adjacent conductors and a single contact. Another deficiency of many flat ribbon cable connectors is a tendency for mating portions of their housings to bow in opposite directions and thereby cause separation between certain contacts and conductors and a loss of electrical contact therebetween. As a result of attempts to alleviate this problem, there have been developed connectors having contacts fixed to one-half of a housing and including latching mechanisms that engage a mating housing part so as to improve the structural integrity of the unit. Although generally quite effective in preventing housing separation, prior latch mechanisms have complicated the problems associated with the close dimensional tolerances required for contacts and have thereby accentuated the difficulties caused by interconnection between adjacent conductors and a single contact.

The object of this invention, therefore, is to provide an improved connector for flat ribbon cable and including contacts that reliably establish discrete contact with individual conductors of the cable in addition to enhancing the structural integrity of the connector unit.

SUMMARY OF THE INVENTION

The invention is a connector for terminating flat ribbon cable composed of flexible electrical insulation and retaining a plurality of electrical isolated, parallel conductors. The connector includes a housing that defines a slot for receiving an end of a flat ribbon cable to be terminated and comprises a base that defines a row of contact receptacles extending transversely to the slot and aligned with individual conductors in the cable. Also comprising the housing is a cover adapted for mating engagement with the base and defining catch wall portions extending transversely to the cable slot. Retained by each of the receptacles is a contact having a head portion having cutting edges shaped and arranged to receive and penetrate the insulation surrounding a different conductor in the cable and to make electrical contact therewith. The contacts also include latch portions for engaging and fastening the cover of the housing to the base. Included in each latching portion is a tab extending substantially longitudinally of the slot and parallel to the cable conductors and arranged to engage the catch wall portion of the cover. The engageable latch and catch wall portions enhance the structural integrity of the housing and the orientation of the tabs in a direction parallel to the cable's conductors reduces the possibility of interconnection between adjacent conductors and a single contact.

In a featured embodiment of the invention, the tabs comprise piercing portions that pierce into the catch wall that defines with a retaining wall a groove extending transversely to the cable conductors. The catch and retaining walls of the groove preferably are oppositely inclined relative to the latch portions so as to progressively reduce the spacing therebetween during movement of the cover into engagement with the base. The transverse groove with oppositely inclined side walls guides the latching tabs into desired engagement with the catch wall portions and maintains engagement therebetween.

According to another feature of the invention, the head portions of each contact include a pair of cutting walls separated by a slot for receiving one of the conductors and oriented transversely thereto. The spacing between the center of the conductor slot and a line defining the parallel orientation of the contacts tab is equal to one-half the spacing between the adjacent conductors of the cable. With this arrangement, the upper edge of the latch portion serves as a guide that is received by a valley portion of the cable and thereby aligns the directly adjacent conductor with the conductor slot during penetration thereby of the insulated cable.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENT

Figure 1:
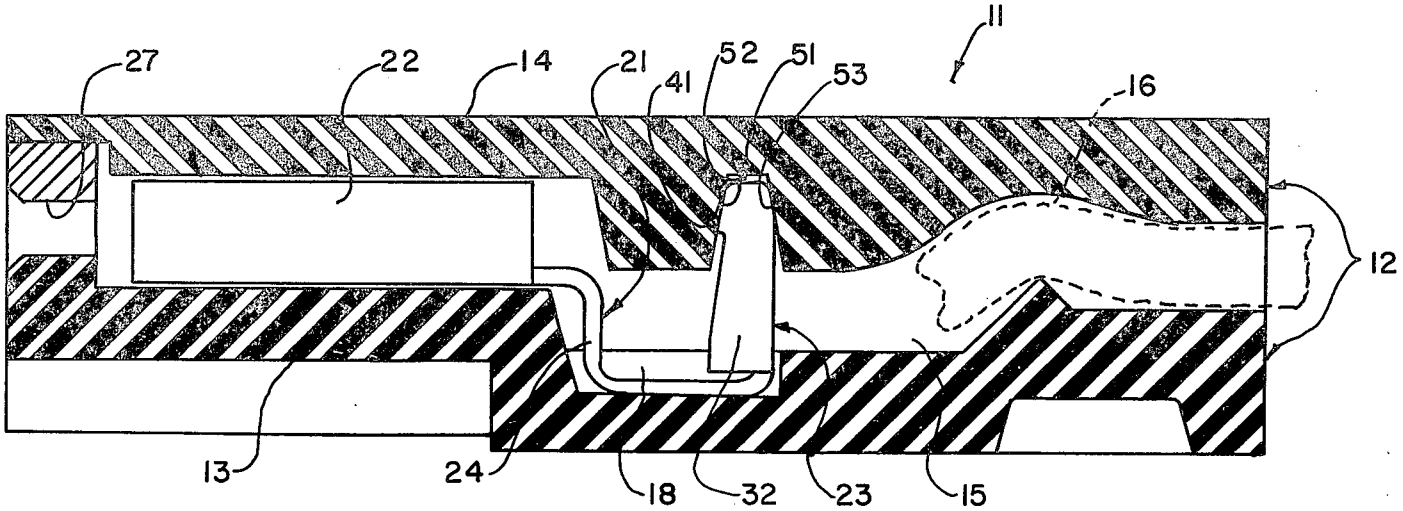
FIG. 1 is a schematic cross-sectional view illustrating a flat ribbon cable connector according to the invention.

Referring now to FIG. 1 there is schematically shown a connector 11 constructed according to the invention. The connector 11 includes a housing 12 composed of a base 13 and a cover 14 therefor. The base 13 and cover 14 are securely fixed together by suitable fasteners (not shown) such as pins, screws or clamps.

Figure 3:
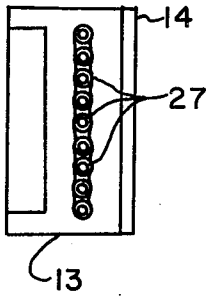
FIG. 3 is a schematic end view of the connector shown in FIGS. 1 and 2.
Figure 2:
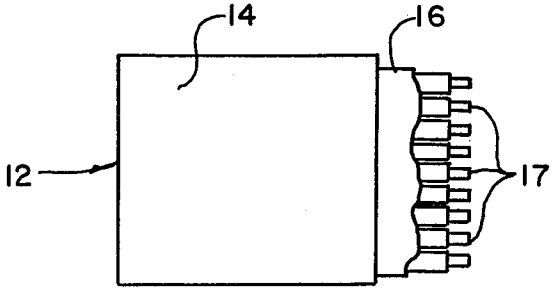
FIG. 2 is a schematic top view of the connector shown in FIG. 1.

Defined by the housing 12 between the base 13 and the cover 14 is a longitudinal slot 15 that receives an end of flat ribbon cable 16 as shown in FIG. 2. The cable 16 is a conventional type including a plurality of parallel electrical conductors 17 imbedded within a resilient ribbon of electrical insulation. Also defined by the base 13 is a row of contact receptacles 18 extending transversely to the slot 15. Although only one receptacle 18 is shown in FIG. 1, it will be understood that a separate receptacle is provided for each conductor 17 of the ribbon cable 16. Each of the receptacles 18 securely retains an electrical unit 21 including an electrical plug 22 and a contact 23 joined by an intermediate portion 24. The electrical plugs 22 are adapted to receive the prongs of a suitable header (not shown) through openings 27 defined at one end of the base 13 as shown in FIG. 3.

Figure 4:
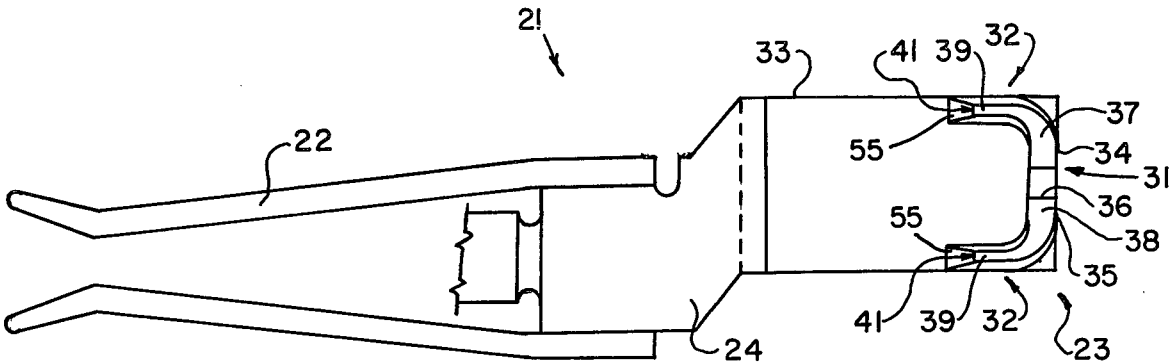
FIG. 4 is a schematic front view of a connector shown in FIG. 1.
Figure 5:
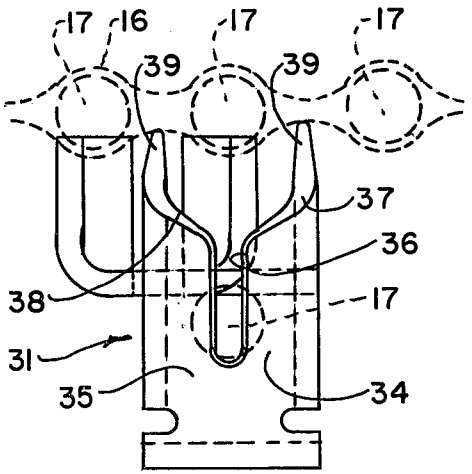
FIG. 5 is a schematic top view of the connector shown in FIG. 4.

Illustrated in greater detail in FIGS. 4 and 5 is one of the electrical units 21. Each unit 21 includes a head portion 31 straddled by a pair of latch portions 32 supported by a contact base portion 33. The head portion 31 is formed by a pair of cutting walls 34 and 35 separated by a conductor slot 36. As shown in FIG. 4, the upper edges 37 and 38 of the walls 34 and 35, respectively, are tapered downwardly so as to guide an individual conductor 17 of the cable 16 into the conductor slot 36. The edges 37 and 38 and the edges defining the conductor slot 36 are adapted to penetrate the cable insulation and produce electrical contact between a conductor 17 (shown by dotted lines in FIG. 4) and the head portion 31. To facilitate electrical contact between each of the conductors 17 and one of the contacts 23, the cutting walls 34 and 35 are oriented transversely to the conductors 17 one of which is in axial alignment with each of the conductor slots 36. Conversely the latch portions 32 extend parallel to the conductors 17 and therefore substantially perpendicular to the cutting walls 34 and 35. Defined by each latch portion 32 is a tab 41 that also extends longitudinally of the slot 15 and parallel to the conductors 17 of the ribbon cable 16. The upper surface 39 of each latch portion 32 slopes downwardly and curves toward a conductor slot 36 so as to smoothly join the upper surfaces 37 and 38 of the cutting walls 34 and 35. Thus, the surfaces 38 and 39 provide a smooth ramp for guiding a conductor 17 into the conductor slot 36.

Referring again now to FIG. 1, the cover 14 defines a groove 51 extending transversely to the slot 15 and the conductors 17 and aligned with the row of latch portions 32. Forming the groove 51 are a catch wall portion 52 and a retainer wall portion 53 spaced therefrom. The catch wall portion 52 and retainer wall portion 53 are oppositely inclined with respect to the latch portions 32 so as to provide therefor a converging opening. Therefore, during movement of the cover 14 into engagement with the base 13, the reducing dimension between the catch surface 52 and the retaining surface 53 guides the latch portions 32 into the groove 51 and retains it therein. However, with the cover 14 and the base 13 in complete engagement and the latch portions 32 fully within the groove 51, the widths of the latch portions 32 defining the tabs 41 are greater than the corresponding spacing between the catch surface 52 and the retaining surface 53. For this reason, complete projection of the latch portions 32 into the groove 51 causes a pointed engaging edge 55 surface of the tabs 41 to pierce into the catch surface 52. As shown in FIG. 4, the engaging surfaces 55 are transverse to a wire received by the conductor slot 36. Also, the catch wall surfaces 52 lie in planes which intersect the axes of the conductors 17 and include lines transverse to the cable 16 and substantially perpendicular to those axes. Those factors minimize the possibility of inadvertent engagement between the surfaces 55 and an adjacent conductor in the cable 16. Also, the forces produced by engagement between the surfaces 55 and the catch surface 52 are unidirectionally parallel to the conductor received by the conductor slot 36 and therefore have substantially no component that would cause relative movement between the cutting walls 34 and 35. After penetration of the catch surface 52 by the engaging surfaces 55 cold flow of the material forming the cover 14 around the tabs 41 creates a latching effect that securely fastens the latching portions 32 to the cover 14. This in turn creates a mechanical connection between the cover 14 and the base 13 at the positions occupied by each of the latch portions 32. The mechanical connections enhance the structural integrity of the housing 12 and prevent the cover 14 and base 13 from bowing in opposite directions around a central axis parallel to the conductors 17 of the ribbon cable 16.

Obviously, many modifications and variations of the present invention are possible in light of the above teachings. It is to be understood, therefore, that the invention can be practiced otherwise than as specifically described.

What is claimed is:

1. A connector for terminating flat ribbon cable composed of electrical insulation and retaining a plurality of electrically isolated, parallel conductors, said connector comprising:

a housing means defining a slot for receiving an end of the flat ribbon cable to be terminated, said housing means comprising a base defining a row of contact receptacles extending transversely to said slot such that individual receptacles are aligned with individual conductors in the cable, said housing means further defining a cover for said base and defining catch means having catch wall portions extending transversely to said slot; and a plurality of contacts, one retained and secured by each of said receptacles and each comprising a head portion having cutting edges adapted and arranged to receive and penetrate the insulation surrounding a different conductor in the cable and to make electrical contact therewith, each of said contacts further comprising a latch portion for engaging said catch means so as to fasten said base to said cover, said latch portion comprising a tab extending toward one of said catch wall portions and having an engaging surface for fastening thereto and wherein said one catch wall position is in a plane intersecting the axis of the contacted portion of said different conductor and including a line transverse to said cable and substantially perpendicular to said axis.

2. A connector according to claim 1 wherein each of said tabs comprise a piercing portion for penetrating said catch wall portion.

3. A connector according to claim 1 wherein said catch wall portion is inclined relative to said tab so as to progressively reduce the spacing therebetween during movement of said cover into engagement with said base.

4. A connector according to claim 3 wherein each of said tabs comprise a piercing portion for penetrating said catch wall portion.

5. A connector according to claim 3 wherein said catch means further comprises retaining wall portions defining with said catch wall portions cavity means each of said retaining wall portions arranged to engage a back portion comprised by one of said latch portions and disposed opposite said tab.

6. A connector according to claim 5 wherein said retaining wall portions are inclined oppositely to said catch wall portions.

7. A connector according to claim 6 wherein each of said tabs comprise a piercing portion for penetrating said catch wall portion.

8. A connector according to claim 1 wherein each of said head portions comprise a pair of cutting walls separated by a conductor slot for receiving one of the conductors, said cutting walls oriented transversely to the conductors and substantially perpendicular to said latch portion.

9. A connector according to claim 8 wherein one of said cutting walls is joined to said latch portion.

10. A connector according to claim 9 including a second said latch portion joined to the other of said cutting walls.

11. A connector according to claim 8 wherein the spacing between the mid-point of said conductor slot and a line defining said parallel orientation of said tab is substantially equal to one-half the spacing between adjacent conductors of said cable.

12. A connector according to claim 11 wherein said catch wall portions are inclined relative to said tabs so as to progressively reduce the spacing therebetween during movement of said cover into engagement with said base.

13. A connector according to claim 12 wherein said catch means further comprises retaining wall portions defining with said catch wall portions cavity means, each of said retaining wall portions arranged to engage a back portion comprised by one of said latch portions and disposed opposite said tab.

14. A connector according to claim 13 wherein each of said tabs comprise a piercing portion for penetrating said catch wall portion.

15. A connector for terminating a plurality of insulated electrical conductors, said connector comprising:

a housing means defining a slot for receiving the ends of the conductors, said housing comprising a base defining a row of contact receptacles and a cover defining catch means having catch portions aligned with said receptacles; and a plurality of contacts each retained by one of said receptacles and comprising spaced apart cutting edges that define a conductor slot for receiving a different one of the conductors, said cutting edges being adapted and arranged to penetrate the insulation surrounding the received conductor and to make electrical contact therewith, each of said contacts further comprising a latch means with engaging surface means for engaging said catch means so as to fasten said base to said cover, and wherein said catch means and engaging surface means are shaped and arranged such that the forces produced in response to engagement therebetween are oriented so as to have substantially no tendency to cause relative movement between said cutting edges.

16. A connector according to claim 15 wherein said forces are directed substantially parallel to the conductor retained by said conductor slot.

17. A connector according to claim 15 wherein said latch means comprise a latch portion connected to each of said cutting edges and said engaging surface means comprises an engaging surface on each of said latch portions, and wherein said catch means and said engaging surfaces are shaped and arranged such that the forces produced in response to engagement therebetween are substantially unidirectional.

18. A connector according to claim 17 wherein said engaging surfaces are displaced in the same direction from a plane defined by said cutting edges.

19. A connector according to claim 18 wherein said forces are directed substantially parallel to the conductor retained by said conductor slot.

20. A connector according to claim 19 wherein said cutting edges are formed by cutting walls that extend transversely to the conductor retained by said conductor slot, and said latch portions extend substantially parallel to the conductor.

21. A connector according to claim 20 wherein said catch means comprises a catch wall, and each of said engaging surfaces are adapted to penetrate said catch wall during engagement therebetween.

* * * * *